US007909629B2

(12) United States Patent
Lev et al.

(10) Patent No.: US 7,909,629 B2
(45) Date of Patent: Mar. 22, 2011

(54) COMPUTER DEVICE WITH RETRACTABLE CONNECTOR

(75) Inventors: Jeffrey A. Lev, Cypress, TX (US); Paul J. Doczy, Cypress, TX (US); Jonathan R. Harris, Cypress, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 39 days.

(21) Appl. No.: 12/250,474

(22) Filed: Oct. 13, 2008

(65) Prior Publication Data

US 2009/0035972 A1 Feb. 5, 2009

Related U.S. Application Data

(62) Division of application No. 11/254,893, filed on Oct. 20, 2005, now Pat. No. 7,452,225.

(51) Int. Cl.
*H01R 13/64* (2006.01)

(52) U.S. Cl. ..... 439/247

(58) Field of Classification Search ..... 439/131, 439/247, 248

See application file for complete search history.

(56) References Cited

U.S. PATENT DOCUMENTS

| | | | | |
|---|---|---|---|---|
| 5,183,404 | A * | 2/1993 | Aldous et al. | 439/55 |
| 6,476,795 | B1 * | 11/2002 | Derocher et al. | 345/163 |
| 6,488,542 | B2 * | 12/2002 | Laity | 439/676 |
| 6,707,664 | B2 * | 3/2004 | Murphy | 361/679.16 |
| 6,845,158 | B2 * | 1/2005 | Koester et al. | 379/438 |
| 7,074,065 | B1 * | 7/2006 | Martinez et al. | 439/247 |
| 2001/0002344 | A1 * | 5/2001 | Yokoi | 439/247 |

* cited by examiner

*Primary Examiner* — Khiem Nguyen

(57) ABSTRACT

A computer device comprising a connector configured to be coupled to an external device, the connector configured to be disposed flush with an opening in a housing of the computer device in an extended position, the connector configured to retract from the opening in a retracted position.

21 Claims, 1 Drawing Sheet

COMPUTER DEVICE WITH RETRACTABLE CONNECTOR

CROSS-REFERENCE TO RELATED APPLICATION

This application is a divisional of U.S. application Ser. No. 11/254,893, entitled "Computer Device With Retractable Connector," filed Oct. 20, 2005.

BACKGROUND OF THE INVENTION

Computer devices, such as laptop or notebook computers, have connectors located along the periphery of the computer device to enable a variety of types of external components to be connected to the computer device. However, during transport of the computer device or storage of the computer device within a computer case, the external device connected to the computer is susceptible to damage (e.g., from inadvertent contact of the external device with other structures).

BRIEF DESCRIPTION OF THE DRAWINGS

For a more complete understanding of the present invention, and the objects and advantages thereof, reference is now made to the following descriptions taken in connection with the accompanying drawings in which.

DETAILED DESCRIPTION OF THE DRAWINGS

Figure 1:
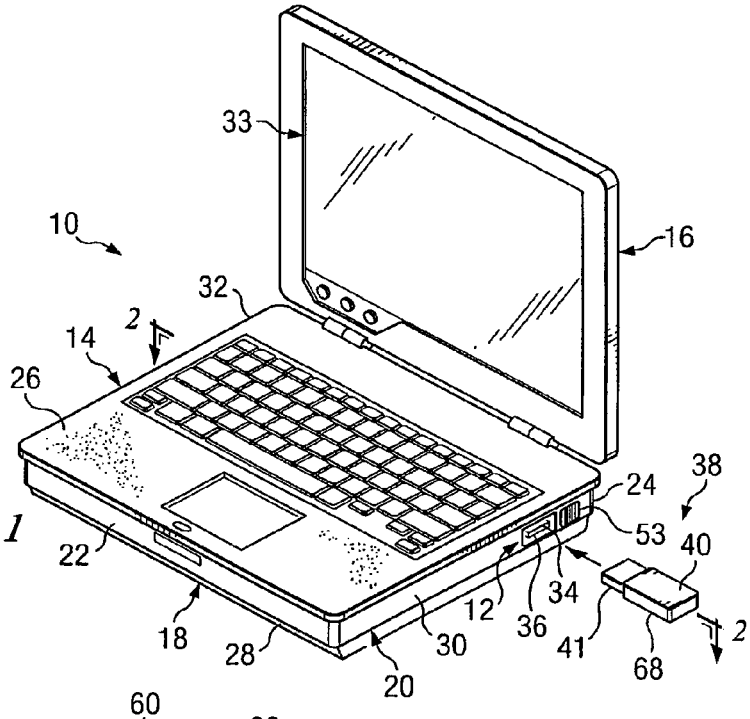
FIG. 1 is a side perspective view of an embodiment of a computer device having a retractable connector in accordance with the present invention.
Figure 2A:
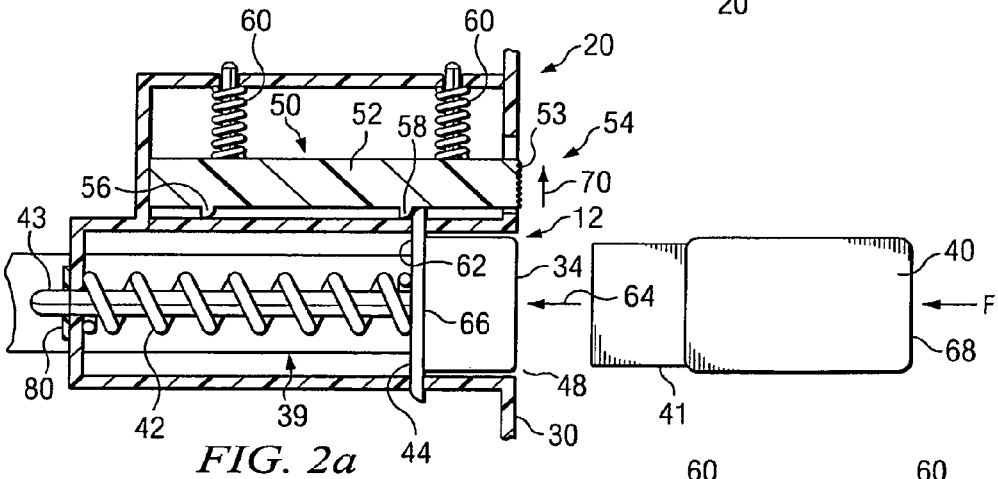
FIG. 2*a* is a section view of a portion of the computer device of FIG. 1 taken along the line 2-2 of FIG. 1 illustrating the retractable connector in a non-retracted position.
Figure 2B:
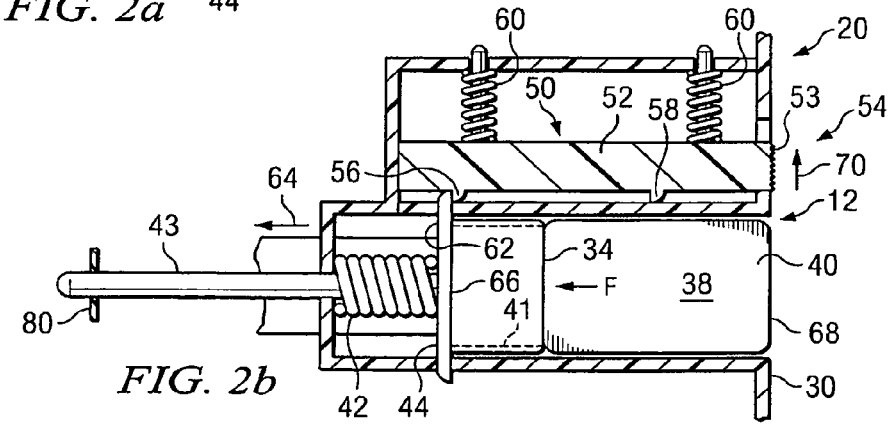
FIG. 2*b* is a section view of a portion of the computer device of FIG. 1 taken along the line 2-2 of FIG. 1 illustrating the retractable connector in a retracted position.

The preferred embodiments of the present invention and the advantages thereof are best understood by referring to FIGS. 1-2*b* of the drawings, like numerals being used for like and corresponding parts of the various drawings.

FIG. 1 is a diagram illustrating an embodiment of a computer device 10 having a retractable connector 12 in accordance with the present invention. In the embodiment illustrated in FIG. 1, computer device 10 comprises a laptop or notebook computer comprising a display member 16 rotatably coupled to a base member 18. However, it should be understood that computer device 10 may comprise any type of computer device such as, but not limited to, a desktop computer, a tablet personal computer, a handheld computing device, or any other type of portable or non-portable computer device. In the embodiment illustrated in FIG. 1, base member 18 comprises a housing 20 having a front surface 22, a rear surface 24, a working surface 26, a bottom surface 28 and a pair of side surfaces 30 and 32. In FIG. 1, a single retractable connector 12 is illustrated disposed on side surface 30. However, it should be understood that a greater number of retractable connectors 12 may be provided on surface 30 and/or on any other surface of base member 16 (e.g., surfaces 22, 24, 26, 28 and/or 32). Additionally or alternatively, retractable connector 12 may be disposed on any surface of a housing 33 of display member 16.

In the embodiment illustrated in FIG. 1, retractable connector 12 comprises a connector element 34. In the embodiment illustrated in FIG. 1, connector element 34 comprises a universal serial bus ("USB") connector. However, it should be understood that connector element 34 may comprise any type of connector element configured to be communicatively coupled to an external device 38. In the embodiment illustrated in FIG. 1, external device 38 comprises a USB key 40 (e.g., for storing data and/or otherwise providing a security function). USB key 40 comprises a connector element 41 configured to cooperate with connector element 34 to communicatively couple USB key 40 to computer device 10. It should be understood that external device 38 may comprise other types of external devices such as, but not limited to, security locks, wireless antennas, and wireless mouse and/or keyboard sensors. In operation, connector 12 is retractable into at least a portion of housing 20 to enable a particular external device 38 (e.g., USB key 40) connected to computer device 10 to be at least partially or fully inserted within housing 20 into a flush condition with an external surface of housing 20, thereby minimizing and/or substantially eliminating the likelihood of potential damage to the external device 38. As used herein, "flush" shall mean flush or substantially flush with another surface.

FIGS. 2*a* and 2*b* are partial section views of computer device 10 taken along the line 2-2 of FIG. 1 illustrating retractable connector 12 operable between an extended or non-retracted and a retracted position, respectively. In the embodiment illustrated in FIGS. 2*a* and 2*b*, retractable connector 12 is moveably and/or retractably coupled to housing 20. In the embodiment illustrated in FIGS. 2*a* and 2*b*, retractable connector 12 comprises a plunger assembly 39 having a biasing mechanism 42 (e.g., a spring or other type of biasing element) disposed about a plunger rod 43, and a tray 44 coupled to connector element 34. Communicative coupling of connector element 34 to internal circuitry of computer device 10 may be provided using a variety of methods or devices such as, but not limited to, a flexible and/or retractable cable, engagement of a portion of connector element 34 with another internally disposed connector element, or otherwise. Referring to FIG. 2*a*, biasing mechanism 42 biases connector element 34 toward an opening 48 of surface 30 such that, in a non-retracted or extended position of connector 12, connector element 34 is disposed flush with surface 30. Referring to FIG. 2*b*, plunger assembly 41 retracts inwardly into housing 20 such that when external device 38 is connected to connector element 34 and external device 38/connector element 34 are pushed inwardly in the direction indicated by 64, external device 38 is disposed flush with surface 30.

In the embodiment illustrated in FIGS. 2*a* and 2*b*, a locking mechanism 50 is configured to releasably secure retractable connector 12 in at least two different positions relative to housing 20: 1) in the extended position (FIG. 2*a*) to facilitate engagement of external device 38 with connector element 34; and 2) in a retracted position to maintain external device 38 positioned flush with surface 30. In the embodiment illustrated in FIGS. 2*a* and 2*b*, locking mechanism 50 comprises a movable latch 52 having an end 53 accessible through housing 20 via an opening 54 in housing 20, a pair of ribs 56 and 58 disposed on a movable latch 52, and one or more biasing mechanisms 60 (e.g., springs or another type of biasing element). It should be understood that other configurations of locking mechanism 50 may be used to maintain retractable connector 12 in the extended and retracted positions.

In operation, biasing mechanisms 60 exert a force on latch 52 toward plunger assembly 39 to facilitate engagement of rib 58 with tray 44 when retractable connector 12 is in the extended position (FIG. 2*a*), and to facilitate engagement of rib 56 with tray 44 when retractable connector 12 is in the retracted position (FIG. 2*b*). As illustrated in FIG. 2*a*, when retractable connector 12 is disposed in the extended position, rib 58 frictionally engages rear surface 62 of tray 44 to resist retraction of retractable connector 12 into housing 20 while external device 38 is being connected to connector element 34. After connection of external device 38 with connector element 34, a force F may be applied to external device 38 to overcome the frictional engagement of rib 58 with rear surface 62 of tray 44 to enable retraction of connector 12 and, correspondingly, insertion of external device 38, into housing 20. The force F causes movement of connector element 34 and external device 38 in the direction indicated by arrow 64, thereby to compress biasing mechanism 42. In the retracted position, rib 56 engages a front surface 66 of tray 44 to lock or releasably secure connector 12 in the retracted position (FIG. 2*b*). As illustrated in FIG. 2*b*, USB key 40 is connected to connector element 34 and disposed within housing 20 so that an end 68 of USB key 40 is disposed flush with surface 30 of computer device 10.

In the embodiment illustrated in FIGS. 2*a* and 2*b*, retractable connector 12 is releasable from the retracted position to the extended position by exerting a force on end 53 of latch 52 to slide end 53 of latch 52 in the direction indicated by arrow 70, thereby separating and/or disengaging rib 56 from front surface 66 of tray 44. The stored energy in the compressed biasing mechanism 44 acts on tray 44 to move tray 44 in a direction opposite direction 64 to the extended position. In the embodiment illustrated in FIGS. 2*a* and 2*b*, a stop member 80 is disposed on plunger rod 43 to maintain connector 12 in a substantially fixed position relative to housing 20 to facilitate disengagement of external device 38 from connector 12 and to prevent connector 12 from being overextended relative to housing 20. However, it should be understood that other methods or devices may be used to prevent connector 12 from overextending relative to housing 20 and/or facilitating disengagement of external device 38 from connector 12.

Thus, embodiments of the present invention enable a external device 38 to be couplable to a retractable connector 12 such that connector 12 and a portion or an entirety of external device 38 are disposed within housing 20, thereby substantially preventing damage to external device 38 and/or computer device 10 while external device 38 is coupled to computer device 10. However, it should be understood that, in some embodiments of the present invention, external device 38 may protrude from surface 30 when connector 12 is completely retracted.

What is claimed is:

1. A method of manufacturing a computer device, comprising:

providing a connector couplable to an external device; and configuring the connector to be disposed substantially flush within an opening in a housing of the computer device in an extended position, the connector configured to retract away from the opening in a retracted position, the connector including a moveable latch that includes at least one rib disposed on the moveable latch for releasably securing the connector in the retracted position.

2. The method of claim 1, wherein configuring the connector comprises configuring the connector to be retractable into the housing to facilitate disposing at least a portion of the external device within the housing.

3. The method of claim 1, further comprising providing a biasing mechanism to position the connector flush with the opening of the housing in the extended position.

4. The method of claim 1, further comprising providing a locking mechanism to releasably secure the connector in the retracted position.

5. The method of claim 1, further comprising providing a locking mechanism to releasably secure the connector in the extended position.

6. The method of claim 1, further comprising providing a plunger assembly configured to facilitate disengagement of the external device from the connector.

7. The method of claim 1, further comprising providing a stop member configured to facilitate disengagement of the external device from the connector.

8. The method of claim 1, further comprising providing a biasing mechanism configured to position the connector flush with a surface of the housing in the extended position.

9. The method of claim 1, wherein configuring the connector comprises configuring the connector to facilitate positioning of the external device within the housing and flush with the opening in the retracted position.

10. A computer device, comprising:

a housing;

a display connected to the housing; and a retractable connector in the housing and including a connector element that removably connects to an external device that stores data, wherein the connector element biasably retracts into the housing to receive and transmit the data to the computer device when the external device is inserted within the housing such that the external device is flush with an external surface of the housing.

11. The computer device of claim 10, wherein the retractable connector further includes a plunger assembly that retracts into the housing, is connected to the connector element, and has a biasing mechanism disposed about a plunger rod.

12. The computer device of claim 10, wherein the retractable connector is a universal serial bus (USB) connector.

13. The computer device of claim 10, wherein the retractable connector includes a biasing mechanism that biases the connector element to an opening of the housing such that the connector element is flush with a surface of the housing in an extended position and located within the housing in a retracted position.

14. The computer device of claim 10, wherein the retractable connector includes a locking mechanism that secures the connector element in an extended position flush with the housing and secures the connector element in a retracted position to maintain the external device flush with an external surface of the housing.

15. The computer device of claim 10, wherein the retractable connector includes a locking mechanism having a movable latch with an end accessible through the housing via an opening in the housing, a pair of ribs disposed on the movable latch, and a biasing mechanism that biases the movable latch.

16. The computer device of claim 10, wherein the connector element and an entirety of the external device are disposed within the housing to prevent damage to the external device while the external device is coupled to the computer device.

17. The computer device of claim 10, wherein the computer device is a notebook computer and the retractable connector is a universal serial bus (USB) connector located in a base of the notebook computer.

18. The computer device of claim 10, wherein the retractable connector includes a biasing mechanism, a latch, a plunger assembly, a rib, and a tray, wherein the biasing mechanism exerts a force on the latch toward the plunger assembly to facilitate engagement of the rib with the tray when the connector element is in an extended position.

19. The computer device of claim 10, wherein the retractable connector includes a plunge assembly that retracts within the housing, a rib biased against the plunge assembly, and a tray coupled to the connector element, wherein the rib frictionally engages the tray to resist retraction of the connector element into the housing while the external device is being connected to the connector element.

20. A computer device, comprising:

a base having an opening at an external surface;

a display connected to the base; and a retractable connector in the opening of the base and including a connector element that moves from an extended position at the external surface to a retracted position away from the external surface, wherein the connector element removably couples to an external storage device that stores data when the connector element and external storage device retract into the housing until an end of the external storage device is flush with the external surface of the housing.

21. The computer device of claim 20, wherein an entirety of the external storage device is enclosed within the base when the connector element is in the retracted position.

* * * * *